US010227680B2

(12) United States Patent
Tsakiropoulos

(10) Patent No.: US 10,227,680 B2
(45) Date of Patent: Mar. 12, 2019

(54) ALLOYS

(75) Inventor: Panos Tsakiropoulos, Chesterfield Derbyshire (GB)

(73) Assignee: The University of Sheffield, Sheffield, South Yorkshire (GB)

( * ) Notice: Subject to any disclaimer, the term of this patent is extended or adjusted under 35 U.S.C. 154(b) by 621 days.

(21) Appl. No.: 13/000,199

(22) PCT Filed: Jun. 17, 2009

(86) PCT No.: PCT/GB2009/050692
§ 371 (c)(1),
(2), (4) Date: Mar. 31, 2011

(87) PCT Pub. No.: WO2009/153596
PCT Pub. Date: Dec. 23, 2009

(65) Prior Publication Data

US 2011/0182766 A1 Jul. 28, 2011

(30) Foreign Application Priority Data

Jun. 18, 2008 (GB) ..... 08111090.0

(51) Int. Cl.
*C22C 27/02* (2006.01)

(52) U.S. Cl.
CPC ..... *C22C 27/02* (2013.01)

(58) Field of Classification Search
CPC ..... C22C 27/02
USPC ..... 148/422, 442; 420/426, 580, 581, 588, 420/589
See application file for complete search history.

(56) References Cited

U.S. PATENT DOCUMENTS

| | | | | |
|---|---|---|---|---|
| 5,741,376 | A | 4/1998 | Subramanian et al. | |
| 6,409,848 | B1 * | 6/2002 | Bewlay | C22C 27/02 148/422 |
| 6,428,910 | B1 | 8/2002 | Jackson et al. | |
| 2004/0126286 | A1 | 7/2004 | Jackson et al. | |
| 2005/0069449 | A1 | 3/2005 | Jackson et al. | |
| 2006/0172142 | A1 | 8/2006 | Olson et al. | |
| 2007/0020136 | A1 | 1/2007 | Menon | |
| 2007/0023109 | A1 * | 2/2007 | Bewlay | C22C 27/02 148/442 |

FOREIGN PATENT DOCUMENTS

| | | | |
|---|---|---|---|
| CN | 1730699 | A | 2/2006 |
| CN | 100335667 | C | 9/2007 |
| CN | 101168812 | A | 4/2008 |
| CN | 101168815 | A | 4/2008 |
| EP | 1215296 | A1 | 6/2002 |
| JP | 2001226734 | A | 8/2001 |
| JP | 2003306736 | A | 10/2003 |
| JP | 2004232013 | A | 8/2004 |

OTHER PUBLICATIONS

Lyle et al. "Aluminum Alloys." Ullmann's Encyclopedia of Industrial Chemistry. Posted online Jun. 15, 2000.*

Qu et al: "Effects of alloying elements on phase stability in Nb—Si system intermetallics materials" Intermetallics Elsevier Science Publishers B.V, GB, vol. 15, No. 5-6, Apr. 19, 2007 (Apr. 19, 2007), pp. 810-813, XP022035048 ISSN: 0966-9795 the whole document.

Tanaka, R. et al.: "Newly developed niobium-based superalloys for elevated temperature application" The Minerals, Metals & Materials Society, Dec. 31, 2004 (Dec. 31, 2004), pp. 89-98, XP009129327 the whole document.

Geng, J. et al.:"Oxidation of Nb—Si—Cr—Al in situ composites with Mo, Ti and Hf additions" Materials Science and Engineering, Online vol. 441, Oct. 9, 2006, pp. 26-38, XP002567894 DOI: 10.1016/j.msea.2006.08.093; URL:http://www.sciencedirect.com/science?_ob=ArticleURL&_udi=B6TXD-4M2WP55-3&user=987766&_coverDate=12%2F15%2F2006&_rdoc=1&_fmt=high&_orig=search&_sort=d&_docanchor=&view=c& acct=C000049880&_version=1&_ur1Version=0&_userid=987766&md5=2f54d42bf8df71045flbbb8a4331cea7> [retrieved on Feb. 9, 2010] the whole doc.

Geng et al: A study of the effect of Hf and Sn additions on the microstructure of Nbss/Nb5Si3 based in situ composites: Intermetallics, Elsevier Science Publishers B.V, GB LNKD—DOI: 10.1016/J.Intermet.Mar. 1, 2006, vol. 15, No. 1, Nov. 1, 2006 (Nov. 1, 2006), pp. 69-76, XP005841347 ISSN: 0966-9795 the whole document table 1.

Liu Aiqin et al: "Effect of B on the microstructures and high temperature oxidation resistance of a Nb—Si system in-situ composite" Materials Science Forum, Aedermannsfdorf, CH, vol. 546-549, Jan. 1, 2007 (Jan. 1, 2007), pp. 1489-1494, XP009129325 ISSN: 0255-5476 the whole document * abstract p. 1494.

Geng et al., A thermo-gravimetric and microstructural study of the oxidation of Nbss/Nb5Si3-based in situ composites with Sn addition, Intermetallics, Elsevier, Science Direct, vol. 15 (2007), pp. 270-281.

* cited by examiner

*Primary Examiner* — Brian D Walck
(74) *Attorney, Agent, or Firm* — Evan Law Group LLC

(57) ABSTRACT

A first multi phase niobium silicide alloy composition consists essentially of: from 15 to 24 at % of Si; from 0 to 25 at % of one or more sp outer electron configuration element which is not Si; from 1 to 26 at % of one or more sd outer electron configuration element which is not Nb; and a balance of Nb, interstitials and impurities. This alloy may be used to increase the creep resistance of an article, for example a gas turbine engine blade. A second multi phase niobium silicide alloy composition consists essentially of: from 1 to 24 at % of Si; from 0 to 34 at % of one or more sp outer electron configuration element which is not Si; from 19.5 to 48.5 at % of one or more sd outer electron configuration element which is not Nb or Cr; from 0.5 to 9 at % Cr; and a balance of Nb, interstitials and impurities. This alloy may be used to increase the creep resistance and/or to increase the oxidation resistance of an article, for example a gas turbine engine blade.

43 Claims, No Drawings

ALLOYS

The present invention relates to alloys, in particular multi phase niobium silicide alloys that are suitable for use in turbines such as gas turbine engines.

In state of the art gas turbine engines, nickel superalloys are commonly used for the blades (aerofoils). However, these alloys have melting temperatures below the gas temperatures encountered during the operation of such engines. The combustion gases in such an engine are commonly as high as 1500° C. Specifically, these nickel superalloys cannot cope with temperatures above 1200° C. as there is the danger of melting.

Currently, techniques such as (a) the use of thermal barrier coatings, which help drop the temperature at the surface of the aerofoil to 1200° C. or less, and (b) air cooling of the blades, to keep the temperature at the surface of the aerofoil to 1200° C. or less, are utilised to allow the use of gas temperatures in excess of the melting point of the Ni-based alloys. The blades are also protected from oxidation by the coatings.

However, these techniques cannot be further developed to allow any significant further increase in operating temperature. A higher operating temperature is desirable for better engine efficiency and for environmental reasons.

Further, the air-cooling of the blades has an adverse effect on engine efficiency. The opportunity to run the engine without air-cooling would therefore allow further improvement in efficiency.

There is therefore a need for materials to be used in gas turbine engines that can withstand higher temperatures, so that the operating temperature of gas turbine engines can be increased.

Creep behaviour is one of the factors that limit the maximum operating temperature of a material. Therefore the materials to be used in gas turbine engines should have high creep resistance, i.e. low plastic deformation under constant load.

Preferably, these materials will also be of lower density that the Ni-based alloys. Low density is of course an important criterion for rotating parts.

Over the years niobium has attracted interest in relation to the development of alloys for structural applications at high temperatures. Research on the development of new niobium alloys has concentrated on niobium aluminide based alloys and niobium silicide based alloys. However, Nb and its alloys are known for their poor oxidation resistance in certain environments and their susceptibility to environmental embrittlement.

The blades (aerofoils) have a tip and a root. The root is fixed in the turbine disk and does not experience the very high temperatures of the engine; temperatures are usually in the region of 700 to 800° C. At these temperatures oxidation resistance is also important and therefore for the root area oxidation resistance, ductility, strength and creep resistance are relevant. In contrast, the tip gets very hot, to about 1200° C. and here creep is the primary concern. Therefore the blade material must have excellent creep properties at high temperature.

Accordingly, there is a need for Nb alloys that have superior creep properties at high temperature as compared to state of the art Ni superalloys, and ideally also having reduced density compared to state of the art Ni superalloys. There is also a need for Nb alloys that have improved creep properties compared to state of the art Ni superalloys, whilst also having good oxidation behaviour at 700 to 900° C., and ideally also having reduced density compared to state of the art Ni superalloys.

The present invention provides, in a first aspect, a multi phase niobium silicide alloy composition, consisting essentially of:

a) from 15 to 24 at % of Si;
b) from 0 to 25 at % of one or more sp outer electron configuration element which is not Si;
c) from 1 to 26 at % of one or more sd outer electron configuration element which is not Nb; and
d) a balance of Nb, interstitials and impurities;

wherein (i) the ratio of the amount of Nb, in at %, to the amount of all other sd electron configuration elements, in at %, is from 1.2 to 40;
(ii) the total amount of all sp electron configuration elements, including Si, is from 15 to 40 at %;
(iii) Ti is present in an amount of from 0 to 23 at %; and
(iv) Hf is present in an amount of from 0 to 7 at %.

In particular, the present invention provides, in a first aspect, a multi phase niobium silicide alloy composition, consisting essentially of:

a) from 15 to 24 at % of Si;
b) from 0 to 25 at % of one or more sp outer electron configuration element which is not Si;
c) from 1 to 26 at % of one or more sd outer electron configuration element which is not Nb; and
d) a balance of Nb, interstitials and impurities;

wherein (i) the ratio of the amount of Nb, in at %, to the amount of all other sd electron configuration elements, in at %, is from 1.2 to 40;
(ii) the total amount of all sp electron configuration elements, including Si, is from 18 to 40 at %;
(iii) Ti is present in an amount of from 0 to 23 at %;
(iv) Hf is present in an amount of from 0 to 7 at %;
(v) C is present in an amount of from 0 to 2 at %;
(vi) the total amount of Nb and Si is from 49 to 93 at %; and
(vii) any sd electron configuration element which is not Nb, Ti or Hf that is present in the alloy composition is present in an amount of 8 at % or less.

The niobium silicide based alloys of the present invention can be used to substitute existing Ni superalloys. Surprisingly, they permit an increase in operating temperature, e.g. of 150° C. or higher as compared to Ni superalloys, together with a decrease in density, e.g. of about 25%.

Alloy compositions in accordance with the first aspect of the invention may offer satisfactory or good creep resistance at high temperatures (1050° C. and higher).

The compositions in accordance with the first aspect of the invention may also exhibit other properties, for example they may offer creep resistance at other temperatures (below 1050° C.) and/or they may offer oxidation resistance.

Alloy compositions in accordance with the first aspect are suitable for use as the material for the tip of a gas turbine engine blade.

In one embodiment, the alloy composition consists of:

a) from 15 to 24 at % of Si;
b) from 0 to 25 at % of one or more sp outer electron configuration element which is not Si;
c) from 1 to 26 at % of one or more sd outer electron configuration element which is not Nb; and
d) a balance of Nb, interstitials and impurities.

The alloy composition may contain small amounts of impurities. In the production of the alloys, impurities from various sources may be found in the final product. These so-called impurities are not necessarily detrimental to the properties of the alloy; some may actually be beneficial or they may be purely innocuous.

Some of the impurities may be present as residual elements resulting from certain processing steps. Others may be deliberately added for benefits known in the art. The level of impurities may, for example, be 1 at % or less, preferably 0.5 at % or less, such as 0.2 at % or less, more preferably 0.1 at % or less.

The interstitial elements B, C, N and O may be present in the alloy composition.

The inclusion of B may be beneficial to the oxidation resistance properties of the alloy composition. B may, for example, be present in an amount from 0 to 10 at %, e.g. from 0 to 8 at %, such as from 0 to 7 at %.

C may be present but if so is present at low levels, of 2 at % or less. Preferably C is present at a level of from 0 to 1 at %. In one embodiment, C is not present.

N may be present but preferably is present at low levels, e.g. from 0 to 2 at %. Preferably N is present at a level of from 0 to 1 at %. In one embodiment, N is not present.

O may be present. Indeed, as the skilled man would understand, to make Nb silicide base alloys with no oxygen is essentially not possible. In one embodiment, therefore, O is present at a level of 250 ppm or higher, such as 500 ppm or higher. Preferably, O is present in an amount of 5 at % or less, such as 3 at % or less, or 2 at % or less.

The one or more sd outer electron configuration element that is not Nb may be any transition metal. Accordingly, it may be a Group 3, 4, 5, 6, 7, 8, 9, 10 11 or 12 element.

Preferably, the sd outer electron configuration element is not Tc.

In one embodiment, the one or more sd outer electron configuration element that is not Nb is a Group 3, 4, 5, 6, or 7 element.

For example, the one or more sd outer electron configuration elements may be selected from tungsten (W), titanium (Ti), tantalum (Ta), molybdenum (Mo), hafnium (Hf), zirconium (Zr), vanadium (V), chromium (Cr), scandium (Sc), yttrium (Y) and manganese (Mn).

Preferably, the one or more sd outer electron configuration elements are from Group 4, 5 or 6.

Accordingly, in one embodiment, the one or more sd outer electron configuration elements are selected from tungsten (W), titanium (Ti), tantalum (Ta), molybdenum (Mo), hafnium (Hf), zirconium (Zr), vanadium (V), and chromium (Cr).

In a preferred embodiment, the one or more sd electron configuration element which is not Nb includes one or more refractory metals. In other words, the one or more sd electron configuration element which is not Nb includes one or more of: tungsten (W), tantalum (Ta), molybdenum (Mo), hafnium (Hf), zirconium (Zr), vanadium (V), rhenium (Rh), osmium (Os), iridium (Ir) and chromium (Cr). Preferred refractory metals include tungsten (W), tantalum (Ta), molybdenum (Mo), hafnium (Hf), zirconium (Zr), vanadium (V), and chromium (Cr).

In one such embodiment, the one or more sd electron configuration element which is not Nb includes only refractory metals, for example one, two, three or four refractory metals and no non-refractory metals.

In an alternative such embodiment, the one or more sd electron configuration element which is not Nb includes one or more refractory metal together with one or more non-refractory metal, such as titanium (Ti), iron (Fe) and nickel (Ni). For example, the one or more sd electron configuration element which is not Nb may include one, two, three or four refractory metals together with one or two non-refractory metals.

In one embodiment, the one or more sd electron configuration element which is not Nb includes one or more (such as one, two, three or four) refractory metals selected from tungsten (W), tantalum (Ta), molybdenum (Mo), hafnium (Hf), zirconium (Zr), vanadium (V), and chromium (Cr), and optionally further includes the non-refractory metal titanium (Ti).

In one embodiment, there is from 2 to 26 at % of one or more sd electron configuration element which is not Nb, such as from 3 to 25 at %, e.g. from 5 to 24 at %.

In a preferred embodiment, the composition includes one or both of W and Hf. Preferably, the total amount of W and Hf present in the composition is from 1 to 15 at %, such as from 2 to 14 at %, preferably from 2 to 13 at %, for example from 3 to 12 at %.

It is beneficial to include elements that scavenge oxygen (e.g. Hf that forms hafnia, which is used to provide strength), because oxygen has a high solid solubility in Nb.

It may also be beneficial to include elements to stop oxygen diffusing to the bulk of the alloy (for example Sn, Ge and B) and/or elements that can form oxidation resistant intermetallic phases (for example Cr). It may also be useful to include elements that improve the oxidation behaviour of the Nb solid solution (for example, Ti, Cr and Al). It may also be useful to include elements that improve the high temperature strength (e.g. Mo).

Therefore in one embodiment one or more of Ti, Al, Cr, Sn, Ge. Mo and B is included in the alloy composition.

The present invention requires that Ti is present in an amount of from 0 to 23 at % and that Hf is present in an amount of from 0 to 7 at %. Where any sd electron configuration element which is not Nb, Ti or Hf that is present in the alloy composition, each such element is present in an amount of 8 at % or less, preferably 7 at % or less, such as 6 at % or less, more preferably 5 at % or less. It is important to ensure these elements are present at levels of no more than 8 at % each, as their presence at higher levels would be unduly detrimental to the oxidation properties of the alloy composition.

For example, tungsten (W) may be present from 0 to 8 at %, preferably 0 to 7 at %, such as 0 to 6 at %, more preferably 0 to 5 at %.

For example, tantalum (Ta) may be present from 0 to 8 at %, preferably 0 to 7 at %, such as 0 to 6 at %, more preferably 0 to 5 at %.

For example, molybdenum (Mo) may be present from 0 to 8 at %, preferably 0 to 7 at %, such as 0 to 6 at %, more preferably 0 to 5 at %.

For example, zirconium (Zr) may be present from 0 to 8 at %, preferably 0 to 7 at %, such as 0 to 6 at %, more preferably 0 to 5 at %.

For example, vanadium (V) may be present from 0 to 8 at %, preferably 0 to 7 at %, such as 0 to 6 at %, more preferably 0 to 5 at %.

For example, chromium (Cr) may be present from 0 to 8 at %, preferably 0 to 7 at %, such as 0 to 6 at %, more preferably 0 to 5 at %.

In one embodiment, Ti is present in an amount of from 0 to 22 at %, such as from 0 to 20 at %, preferably from 0 to 15 at %, e.g. from 0 to 13 at %, such as from 0 to 12 at %, e.g. from 0 to 11 at %. In one embodiment, Ti is not present; that is to say there is 0 at % of Ti. In another embodiment, Ti is present in an amount of from 8 to 13 at %, e.g. from 9 to 12 at %, such as from 10 to 11 at %.

In one embodiment, Hf is present in an amount of from 0 to 6 at %, such as from 0 to 5 at %. In one embodiment, Hf is not present; that is to say there is 0 at % of Hf. In another embodiment, Hf is present in an amount of from 1 to 5 at %.

In one embodiment, the sd electron configuration elements which are not Nb are selected from W, Ti, Ta, Mo, Hf, Zr, V and Cr and are present as follows:

- tungsten (W) from 0 to 8 at %, preferably 0 to 7 at %, more preferably 0 to 5 at %;
- titanium (Ti) from 0 to 23 at %, preferably 0 to 20 at %, more preferably 0 to 15 at %;
- tantalum (Ta) from 0 to 8 at %, preferably 0 to 7 at %, more preferably 0 to 5 at %;
- molybdenum (Mo) from 0 to 8 at %, preferably 0 to 7 at %, more preferably 0 to 5 at %;
- hafnium (Hf) from 0 to 7 at %, preferably 0 to 6 at %, more preferably 0 to 5 at %;
- zirconium (Zr) from 0 to 8 at %, preferably 0 to 7 at %, more preferably 0 to 5 at %;
- vanadium (V) from 0 to 8 at %, preferably 0 to 7 at %, more preferably 0 to 5 at %; and
- chromium (Cr) from 0 to 8 at %, preferably 0 to 7 at %, more preferably 0 to 5 at %.

In one embodiment, the ratio of the amount of Nb, in at %, to the amount of all other sd electron configuration elements, in at %, is from 1.5 to 35, such as from 1.6 to 30, e.g. from 1.7 to 25, preferably from 1.8 to 20, such as from 2.0 to 15, e.g. from 2.1 to 14.5.

The one or more sp outer electron configuration element that is not Si is optional. Accordingly, in one embodiment the only sp outer electron configuration element that is present is Si; that is to say there is 0 at % of sp outer electron configuration elements that are not Si.

When present, the one or more sp outer electron configuration element that is not Si may be any element from Group 13, 14, 15 or 16.

In one embodiment, the one or more sp outer electron configuration element that is not Si is selected from aluminium (Al), oxygen (O), nitrogen (N), germanium (Ge), boron (B) and tin (Sn).

Preferably, the one or more sp outer electron configuration element that is not Si is selected from aluminium (Al), oxygen (O) and nitrogen (N); for example it may be aluminium.

In one embodiment, the alloy composition contains from 0 to 20 at % of one or more sp electron configuration element which is not Si, such as from 0.5 to 15 at %. For example there may be from 0 to 10 at %, such as from 0 to 5 at %. In one embodiment there is from 1 to 7 at %, e.g. from 2 to 6 at %.

In one embodiment, the total amount of all sp electron configuration elements, including Si, is from 18 to 35 at %, such as from 18 to 30 at %, preferably from 18 to 28 at %, e.g. from 18 to 27 at %.

In one embodiment, the alloy composition contains from 16 to 24 at % of Si, such as from 17 to 23 at %, e.g. from 18 to 22 at %.

Preferably, the ratio of the amount in at % of all sd electron configuration metals, including Nb, to the amount in at % of all sp electron configuration elements, including Si, is 1.9 or more, for example from 1.9 to 5.6. Preferably, the ratio is from 2.0 to 5.5, such as from 2.5 to 5.0, e.g. from 2.7 to 4.7.

Preferably, the alloy composition includes two or more elements in addition to Nb and Si, such as three or more elements in addition to Nb and Si. In one such embodiment, there are two or more sd elements in addition to Nb, and none, one or more sp elements in addition to Si. In another such embodiment, there is one or more sd element in addition to Nb, and one or more sp element in addition to Si.

In the composition, the total amount of Nb and Si is from 49 to 93 at %, for example it may be from 65 to 93 at % or from 70 to 92 at %.

As a multi phase alloy composition, there are two or more phases, such as three or more phases, e.g. two, three or four phases.

Preferably, the phases of the multi phase alloy are selected from: solid solution ($Nb_{ss}$); 5-3 silicides; 3-1 silicides; and oxides and nitrides of sd electron configuration elements (for example, the phases may comprise NbN, TiN, and/or $TiO_2$).

The 5-3 and 3-1 silicide phases, when present, can be tetragonal, hexagonal, cubic equilibrium or metastable. They can be with or without sp and/or sd electron configuration elements in solid solution.

The oxide and nitride phases, when present, can be stoichiometric or non-stoichiometric.

The solid solution ($Nb_{ss}$) phase, when present, can comprise solid solution grains with or without Si. It can be with or without sd and/or sp electron configuration elements.

It is preferred to include 5-3 tetragonal Nb silicides (beta and alpha) as these have better creep behaviour than the 3-1 Nb silicide and 5-3 hexagonal silicides.

In one embodiment, the alloy composition includes at least a solid solution ($Nb_{ss}$) phase. In one embodiment, the alloy composition includes at least a silicide phase. In one embodiment, the alloy composition includes at least a solid solution ($Nb_{ss}$) phase and a silicide phase.

In one embodiment, the alloy composition contains at least Cr as an sd electron configuration element. In such an embodiment, the ratio of the amount of Nb, in at %, to the amount of all other sd electron configuration elements, in at %, may for example be 2.5 or more, e.g. from 3 to 15. The ratio of the amount in at % of all sd electron configuration metals, including Nb, to the amount in at % of all sp electron configuration elements, including Si, may for example be 5.5 or less, such as from 2.0 to 5.0.

In one such embodiment, the alloy composition also contains Hf as an sd electron configuration element.

For example, the alloy composition may contain Cr and Hf in a total amount of 13 at % or less, for example from 1 to 12 at %, such as from 2 to 11 at %, e.g. from 3 to 10 at %.

The alloy composition may, for example, be of formula Nb-20Si-4Cr-4Hf (at %), or of formula Nb-18Si-5Cr-5Hf (at %), or of formula Nb-22Si-10Ti-5Al-3W-2Cr-2V-1Hf (at %).

In one embodiment, the alloy composition contains at least Al as an sp electron configuration element. In such an embodiment, the ratio of the amount of Nb, in at %, to the amount of all other sd electron configuration elements, in at %, may for example be 2 or more, e.g. from 2 to 25. The ratio of the amount in at % of all sd electron configuration metals, including Nb, to the amount in at % of all sp electron configuration elements, including Si, may for example be 5 or less, e.g. from 2.0 to 4.0.

In one such embodiment, the alloy composition also contains Hf as an sd electron configuration element.

For example, the alloy composition may contain Hf in an amount of 6 at % or less, such as from 1 to 5 at %.

For example, the alloy composition may contain Al+Si in a total amount of 33 at % or less, such as 30 at % or less, e.g. 29 at % or less.

The alloy composition may, for example, be of formula Nb-24Si-3Hf-5Al (at %) or of formula Nb-18Si-5Hf-5Al (at %) or of formula Nb-22Si-10Ti-5Al-3W-2Cr-2V-1Hf (at %) or of formula Nb-20Si-11Ti-5Al-5Hf-5Mo-3W (at %).

In one embodiment, the alloy composition contains at least W as an sd electron configuration element. In such an embodiment, the ratio of the amount of Nb, in at %, to the amount of all other sd electron configuration elements, in at %, may for example be 2 or more, e.g. from 2 to 20. The ratio of the amount in at % of all sd electron configuration metals, including Nb, to the amount in at % of all sp electron configuration elements, including Si, may for example be 2.5 or more, e.g. from 3 to 5.

In one such embodiment, the alloy composition also contains Mo as an sd electron configuration element.

For example, the alloy composition may contain Mo and W in a total amount of 12 at % or less, for example from 1 to 10 at %, such as from 3 to 9 at %, e.g. from 4 to 8 at %.

The alloy composition may, for example, be of formula Nb-24Si-2Mo-2W (at %) or formula Nb-22Si-5Mo-3W (at %) or formula Nb-18Si-10Ti-5Mo-3W-1Hf (at %) or formula Nb-20Si-5Hf-5Mo-3W (at %) or formula Nb-19Si-11Ti-5Mo-3W (at %) or formula Nb-11Ti-20Si-5Hf-5Mo-3W (at %).

In one embodiment, the alloy composition contains at least Hf and Ti as sd electron configuration elements. In such an embodiment, the ratio of the amount of Nb, in at %, to the amount of all other sd electron configuration elements, in at %, may for example be 5.5 or less, e.g. from 2.0 to 5.5. The ratio of the amount in at % of all sd electron configuration metals, including Nb, to the amount in at % of all sp electron configuration elements, including Si, may for example be 2.5 or more, e.g. from 3.0 to 5.0.

In one such embodiment, the alloy composition also contains Mo as an sd electron configuration element.

For example, the alloy composition may contain W and Hf in a total amount of from 2 to 10 at %, for example from 3 to 9 at %, such as from 4 to 8 at %.

The ratio of the amount of Ti, in at %, to the total amount of Hf, Mo and W, in at %, may be from 0.7 to 5, such as from 0.8 to 3.5, e.g. from 0.8 to 2.5.

The alloy composition may, for example, be of formula Nb-22Si-10Ti-3Mo-3W-2Hf (at %), or of formula Nb-18Si-10Ti-5Mo-3W-1Hf (at %), or of formula Nb-20Si-11Ti-5Mo-3W-5Hf (at %), or of formula Nb-20Si-5Al-11Ti-5Mo-3W-5Hf (at %).

In one embodiment, the alloy composition contains at least Hf and W as sd electron configuration elements. In such an embodiment, the ratio of the amount of Nb, in at %, to the amount of all other sd electron configuration elements, in at %, may for example be 2.0 or more e.g. from 2.0 to 25.0. The ratio of the amount in at % of all sd electron configuration metals, including Nb, to the amount in at % of all sp electron configuration elements, including Si, may for example be 3 or more, e.g. from 3.0 to 5.0.

In one such embodiment, the alloy composition also contains Mo as an sd electron configuration element.

For example, the alloy composition may contain Mo and Hf in a total amount of from 1 to 15 at %, for example from 2 to 10 at %.

The ratio of the total amount of Hf and W in at %, to the total amount of Hf and Mo, in at %, may be from 0.5 to 2.5, such as from 0.6 to 2.0, e.g. from 0.65 to 1.2.

The ratio of the amount of Si, in at %, to the total amount of Hf and W, in at %, may be from 1.5 to 13, such as from 2.0 to 12, e.g. from 2.5 to 11.

The alloy composition may, for example, be of formula Nb-22Si-1Hf-1Mo-1W (at %) or formula Nb-20Si-5Hf-5Mo-3W (at %) or formula Nb-22Si-10Ti-3Mo-3W-2Hf (at %), or of formula Nb-18Si-10Ti-5Mo-3W-1Hf (at %), or of formula Nb-20Si-11Ti-5Mo-3W-5Hf (at %), or of formula Nb-20Si-5Al-11Ti-5Mo-3W-5Hf (at %).

In one embodiment, the alloy composition contains at least Ti as sd electron configuration element. In such an embodiment, the ratio of the amount of Nb, in at %, to the amount of all other sd electron configuration elements, in at %, may for example be 10 or less, e.g. from 2.0 to 8.0. The ratio of the amount in at % of all sd electron configuration metals, including Nb, to the amount in at % of all sp electron configuration elements, including Si, may for example be 2.5 or more, e.g. from 2.5 to 5.0.

In one such embodiment, the alloy composition also contains Mo as an sd electron configuration element.

In one such embodiment, the alloy composition also contains W as an sd electron configuration element.

The ratio of the amount of Si, in at %, to the total amount of Mo and W, in at %, may be from 1.5 to 12, such as from 1.8 to 10, e.g. from 2.0 to 9.

The alloy composition may, for example, be of formula Nb-22Si-10Ti-3Mo-3W (at %) or formula Nb-19Si-11Ti-5Mo-3W (at %) or formula Nb-22Si-10Ti-3Mo-3W-2Hf (at %), or of formula Nb-18Si-10Ti-5Mo-3W-1Hf (at %), or of formula Nb-20Si-11Ti-5Mo-3W-5Hf (at %), or of formula Nb-20Si-5Al-11Ti-5Mo-3W-5Hf (at %).

In one embodiment, the alloy composition contains at least Ti and Mo as sd electron configuration elements. In such an embodiment, the ratio of the amount of Nb, in at %, to the amount of all other sd electron configuration elements, in at %, may for example be 5.5 or less, e.g. from 2.0 to 5.5. The ratio of the amount in at % of all sd electron configuration metals, including Nb, to the amount in at % of all sp electron configuration elements, including Si, may for example be 2.5 or more, e.g. from 2.5 to 5.

In one such embodiment, the alloy composition also contains W as an sd electron configuration element.

In one such embodiment, the alloy composition also contains Hf as an sd electron configuration element.

The ratio of the total amount of Ti and Hf, in at %, to the total amount of Mo and W, in at %, may be from 1 to 9, e.g. from 1.2 to 7, such as from 1.3 to 6.

The alloy composition may, for example, be of formula Nb-18Si-10Ti-1Hf-1Mo-1W (at %) or formula Nb-11Ti-20Si-5Hf-5Mo-3W (at %) or formula Nb-22Si-10Ti-3Mo-3W-2Hf (at %), or of formula Nb-18Si-10Ti-5Mo-3W-1Hf (at %), or of formula Nb-20Si-11Ti-5Mo-3W-5Hf (at %), or of formula Nb-20Si-5Al-11Ti-5Mo-3W-5Hf (at %).

In one embodiment, the alloy composition contains at least Ti as sd electron configuration element and Al as sp electron configuration element. In such an embodiment, the ratio of the amount of Nb, in at %, to the amount of all other sd electron configuration elements, in at %, may for example be 5 or less, e.g. from 2.0 to 4.0. The ratio of the amount in at % of all sd electron configuration metals, including Nb, to the amount in at % of all sp electron configuration elements, including Si, may for example be 3.5 or less, e.g. from 2.5 to 3.5.

In one such embodiment, the alloy composition also contains Hf as an sd electron configuration element.

In one such embodiment, the alloy composition also contains Mo as an sd electron configuration element.

In one such embodiment, the alloy composition also contains W as an sd electron configuration element.

The ratio of the total amount of Si and Al, in at %, to the total amount of Ti and Hf, in at %, may be from 1.3 to 3.5, such as from 1.4 to 3.0, e.g. from 1.5 to 2.5.

The ratio of the total amount of Ti and Hf, in at %, to the total amount of Mo and W, in at %, may be from 1 to 8, such as from 1 to 5, e.g. from 1.5 to 4.

The alloy composition may, for example, be of formula Nb-18Si-10Ti-5Al-5Hf-5Mo-5W (at %) or of formula Nb-20Si-11Ti-5Al-5Hf-5Mo-3W (at %).

In one embodiment, the alloy composition contains at least Ti and Cr as sd electron configuration element and Al as sp electron configuration element. In such an embodiment, the ratio of the amount of Nb, in at %, to the amount of all other sd electron configuration elements, in at %, may for example be 6 or less, e.g. from 1.2 to 5.0. The ratio of the amount in at % of all sd electron configuration metals, including Nb, to the amount in at % of all sp electron configuration elements, including Si, may for example be 3.5 or less, e.g. from 2.5 to 3.5.

In one such embodiment, the alloy composition also contains W as an sd electron configuration element.

In one such embodiment, the alloy composition also contains V as an sd electron configuration element.

In one such embodiment, the alloy composition also contains Hf as an sd electron configuration element.

The ratio of the total amount of Si and Al, in at %, to the total amount of Cr, V and W, in at %, may be from 1.3 to 11, such as from 1.4 to 8, e.g. from 1.5 to 5.

The ratio of the total amount of Ti and Hf, in at %, to the total amount of V and W, in at %, may be from 1.3 to 8, such as from 1.4 to 6, e.g. from 1.5 to 4.

The alloy composition may, for example, be of formula Nb-18Si-10Ti-5Al-5Cr-5Hf-5V-5W (at %) or formula Nb-22Si-10Ti-5Al-3W-2Cr-2V-1Hf (at %).

In one embodiment, the alloy composition contains at least V and Zr as sd electron configuration elements. In such an embodiment, the ratio of the amount of Nb, in at %, to the amount of all other sd electron configuration elements, in at %, may for example be from 4 to 20, e.g. from 5 to 12. The ratio of the amount in at % of all sd electron configuration metals, including Nb, to the amount in at % of all sp electron configuration elements, including Si, may for example be 3 or more, e.g. from 3.0 to 5.0.

In one such embodiment, the alloy composition also contains W as an sd electron configuration element.

The ratio of the amount of Zr, in at %, to the total amount of V and W, in at %, may be from 0.1 to 1.0, such as from 0.1 to 0.7.

The alloy composition may, for example, be of formula Nb-18Si-3V-1Zr-3W (at %) or of formula Nb-22Si-5V-5Zr-3W (at %).

In one embodiment, the alloy composition contains at least Hf as an sd electron configuration element. In such an embodiment, the ratio of the amount of Nb, in at %, to the amount of all other sd electron configuration elements, in at %, may for example be from 4 to 15, e.g. from 6 to 12. The ratio of the amount in at % of all sd electron configuration metals, including Nb, to the amount in at % of all sp electron configuration elements, including Si, may for example be 3 or more, e.g. from 3 to 5.

In one such embodiment, the alloy composition also contains Ta as an sd electron configuration element.

In one such embodiment, the alloy composition also contains Mo as an sd electron configuration element.

The ratio of the amount of Hf, in at %, to the total amount of Ta and Mo, in at %, may be from 0.3 to 2, such as from 0.5 to 1.5, e.g. from 0.8 to 1.4.

The alloy composition may, for example, be of formula Nb-20Si-4Hf-1Ta-2Mo (at %) or formula Nb-18Si-5Hf-3Ta-2Mo (at %).

In one embodiment, the alloy composition contains at least Hf as an sd electron configuration element. In such an embodiment, the ratio of the amount of Nb, in at %, to the amount of all other sd electron configuration elements, in at %, may for example be 25 or less, e.g. from 1.2 to 20. The ratio of the amount in at % of all sd electron configuration metals, including Nb, to the amount in at % of all sp electron configuration elements, including Si, may for example be 2.5 or more, e.g. from 2.5 to 5.0.

In one such embodiment, the alloy composition also contains W as an sd electron configuration element.

The ratio of the amount of Si, in at %, to the total amount of Hf and W, in at %, may be from 1.5 to 12, such as from 1.6 to 11.5, e.g. from 1.8 to 11.

The alloy composition may, for example, be of formula Nb-24Si-2Hf-2W (at %) or formula Nb-22Si-5Hf-5W (at %) or formula Nb-18Si-5Al-10Ti-5Hf-5Cr-5W-5Ta-5V (at %) or formula Nb-18Si-5Al-10Ti-5Hf-5Mo-5W (at %) or formula Nb-22Si-1Hf-1W-1Mo (at %) or formula Nb-18Si-10Ti-1Hf-1W-1Mo (at %) or formula Nb-22Si-10Ti-2Hf-3W-3Mo (at %) or formula Nb-22Si-5Al-10Ti-1Hf-2Cr-3W-2V (at %) or formula Nb-20Si-5Al-11Ti-5Hf-3W-5Mo (at %) or formula Nb-20Si-11Ti-5Hf-3W-5Mo (at %) or formula Nb-20-Si-5Hf-3W-5Mo (at %) or formula Nb-18Si-10Ti-1Hf-3W-5Mo (at %).

The niobium silicide based alloys of the first aspect have good creep resistance at high temperatures, such as 1050° C. and higher, e.g. 1100° C. and higher; 1150° C. and higher; or even 1200° C. and higher. For example, when in polycrystalline form they may exhibit a creep rate of $7\times10^{-7}$ $s^{-1}$ or less at temperatures up to 1200° C. and at a stress of about 200 MPa.

Specific examples of alloys in accordance with the first aspect include:

Nb-20Si-4Cr-4Hf
Nb-18Si-5Cr-5Hf
Nb-22Si-10Ti-5Al-3W-2Cr-2V-1Hf
Nb-24Si-3Hf-5Al
Nb-18Si-5Hf-5Al
Nb-20Si-11Ti-5Al-5Hf-5Mo-3W
Nb-24Si-2Mo-2W
Nb-22Si-5Mo-3W
Nb-18Si-10Ti-5Mo-3W-1Hf
Nb-20Si-5Hf-5Mo-3W
Nb-19Si-11Ti-5Mo-3W
Nb-11Ti-20Si-5Hf-5Mo-3W
Nb-22Si-10Ti-3Mo-3W-2Hf
Nb-20Si-11Ti-5Mo-3W-5Hf
Nb-20Si-5Al-11Ti-5Mo-3W-5Hf
Nb-22Si-1Hf-1Mo-1W
Nb-22Si-10Ti-3Mo-3W
Nb-18Si-10Ti-1Hf-1Mo-1W
Nb-18Si-10Ti-5Al-5Hf-5Mo-5W
Nb-18Si-10Ti-5Al-5Cr-5Hf-5V-5W
Nb-18Si-3V-1Zr-3W
Nb-22Si-5V-5Zr-3W
Nb-20Si-4Hf-1Ta-2Mo
Nb-18Si-5Hf-3Ta-2Mo
Nb-24Si-2Hf-2W
Nb-22Si-5Hf-5W
Nb-18Si-5Al-10Ti-5Hf-5Cr-5W-5Ta-5V
Nb-18Si-5Al-10Ti-5Hf-5Mo-5W
Nb-22Si-1Hf-1W-1Mo
Nb-18Si-10Ti-1Hf-1W-1Mo
Nb-22Si-10Ti-2Hf-3W-3Mo
Nb-22Si-5Al-10Ti-1Hf-2Cr-3W-2V
Nb-20Si-5Al-11Ti-5Hf-3W-5Mo

Nb-20Si-11Ti-5Hf-3W-5Mo
Nb-20Si-5Hf-3W-5Mo
Nb-18Si-10Ti-1Hf-3W-5Mo

The present invention provides, in a second aspect, a multi phase niobium silicide alloy composition, consisting essentially of:

a) from 1 to 24 at % of Si;
b) from 0 to 34 at % of one or more sp outer electron configuration element which is not Si;
c) from 19.5 to 48.5 at % of one or more sd outer electron configuration element which is not Nb or Cr;
d) from 0.5 to 9 at % Cr; and
e) a balance of Nb, interstitials and impurities;

wherein (i) the ratio of the amount of Nb, in at %, to the amount of all other sd electron configuration elements, in at %, is from 0.5 to 5;
(ii) the total amount of all sp electron configuration elements, including Si, is from 5 to 35 at %;
(iii) the total amount of sd outer electron configuration elements which are not Nb is from 20 to 49 at %;
(iv) Hf is present in an amount of from 0 to 7 at %.

In particular, the present invention provides, in a second aspect, a multi phase niobium silicide alloy composition, consisting essentially of:

a) from 1 to 24 at % of Si;
b) from 0 to 34 at % of one or more sp outer electron configuration element which is not Si;
c) from 19.5 to 48.5 at % of one or more sd outer electron configuration element which is not Nb or Cr;
d) from 0.5 to 9 at % Cr; and
e) a balance of Nb, interstitials and impurities;

wherein (i) the ratio of the amount of Nb, in at %, to the amount of all other sd electron configuration elements, in at %, is from 0.5 to 5;
(ii) the total amount of all sp electron configuration elements, including Si, is from 5 to 35 at %;
(iii) the total amount of sd outer electron configuration elements which are not Nb is from 20 to 49 at %;
(iv) Hf is present in an amount of from 0 to 7 at %;
(v) Mo is present in an amount of from 0 to 7 at %;
(vi) the total amount of B, Sn, Fe and V is 1 at % or higher;
(vii) the one or more sd outer electron configuration element which is not Nb or Cr includes Ti, and optionally further includes one or more element selected from Hf, Ta, Zr, Mo, V, Ru, Mn and Fe.

The niobium silicide based alloys of the present invention can be used to substitute existing Ni superalloys. Surprisingly, they permit an increase in operating temperature, e.g. of 150° C. or higher, together with a decrease in density, e.g. of about 25%.

Alloy compositions in accordance with the second aspect of the invention may offer satisfactory or good oxidation resistance at temperatures of 1000° C. and below.

Alloy compositions in accordance with the second aspect of the invention may offer satisfactory or good creep resistance.

The compositions in accordance with the second aspect of the invention may also exhibit other properties, for example they may offer oxidation resistance at temperatures of above 1000° C. They may also offer creep resistance at such temperatures.

Alloy compositions in accordance with the second aspect are suitable for use as the material for the root of a gas turbine engine blade.

In one embodiment, the alloy composition consists of:

a) from 1 to 24 at % of Si;
b) from 0 to 34 at % of one or more sp outer electron configuration element which is not Si;
c) from 19.5 to 48.5 at % of one or more sd outer electron configuration element which is not Nb or Cr;
d) from 0.5 to 9 at % Cr; and
e) a balance of Nb, interstitials and impurities.

The alloy composition may contain small amounts of impurities. In the production of the alloys, impurities from various sources may be found in the final product. These so-called impurities are not necessarily detrimental to the properties of the alloy; some may actually be beneficial or they may be purely innocuous.

Some of the impurities may be present as residual elements resulting from certain processing steps. Others may be deliberately added for benefits known in the art. The level of impurities may, for example, be 1 at % or less, preferably 0.5 at % or less, such as 0.2 at % or less, more preferably 0.1 at % or less.

The interstitial elements B, C, N and O may be present in the alloy composition.

The inclusion of B may be beneficial to the oxidation resistance properties of the alloy composition. B may preferably be present in an amount from 0 to 10 at %, e.g. from 0 to 8 at %, such as from 0 to 7 at %.

C may be present but preferably is present at low levels, e.g. from 0 to 2 at %. Preferably C is present at a level of from 0 to 1 at %. In one embodiment, C is not present.

N may be present but preferably is present at low levels, e.g. from 0 to 2 at %. Preferably N is present at a level of from 0 to 1 at %. In one embodiment, N is not present.

O may be present. Indeed, as the skilled man would understand, to make Nb silicide base alloys with no oxygen is essentially not possible. In one embodiment, therefore, O is present at a level of 250 ppm or higher, such as 500 ppm or higher. Preferably, O is present in an amount of 5 at % or less, such as 3 at % or less, or 2 at % or less.

The one or more sd outer electron configuration element that is not Nb or Cr does not include Tc.

The one or more sd outer electron configuration metals that is not Nb or Cr are from Group 4, 5, 6, 7 or 8. The sd outer electron configuration element that is not Nb or Cr has density equal to or less than that of Ta.

The one or more sd outer electron configuration elements that is not Nb or Cr includes at least titanium (Ti) and may optionally further include one or more sd outer electron configuration element. Any such further sd outer electron configuration element or elements that are present are selected from tantalum (Ta), molybdenum (Mo), hafnium (Hf), zirconium (Zr), vanadium (V), iron (Fe), ruthenium (Ru), and manganese (Mn).

Therefore the one or more sd outer electron configuration element which is not Nb or Cr cannot include elements other than Ti, Hf, Ta, Zr, Mo, V, Ru, Mn and Fe. For example, W, Y or Pt may not be included as sd outer electron configuration elements.

The presence of Ti is beneficial for oxidation resistance. Whilst a range of amounts of Ti could be used, preferably at least 5 at % is used, such as from 5 to 40 at %, e.g. from 10 to 37 at %; preferably from 15 to 35 at %, more preferably from 20 to 32 at %.

In the event that the one or more sd outer electron configuration element includes Ta, preferably it does not also include Hf.

Preferably, the sd outer electron configuration element that is not Nb or Cr has density equal to or less than that of Hf.

In one embodiment, the one or more sd outer electron configuration element that is not Nb or Cr includes titanium (Ti) and optionally further includes one or more element selected from molybdenum (Mo), hafnium (Hf), zirconium (Zr), vanadium (V), iron (Fe), ruthenium (Ru), and manganese (Mn).

In one embodiment, the one or more sd outer electron configuration element that is not Nb or Cr includes titanium (Ti) and optionally further includes one or more element selected from molybdenum (Mo), hafnium (Hf), vanadium (V), iron (Fe) and manganese (Mn).

In one embodiment, the one or more sd outer electron configuration element that is not Nb or Cr includes titanium (Ti) and optionally further includes one or more element selected from molybdenum (Mo), hafnium (Hf), vanadium (V) and iron (Fe).

In one embodiment, the one or more sd outer electron configuration element that is not Nb or Cr includes titanium (Ti) and optionally further includes one or more element selected from hafnium (Hf), vanadium (V), and iron (Fe).

In one embodiment, there is from 21 to 47 at % of one or more sd electron configuration element which is not Nb or Cr, preferably from 21 to 40 at %, for example from 22 to 39 at %, such as from 23 to 37 at %, e.g. from 24 to 36 at %.

In one embodiment, there is from 20 to 48 at % of one or more sd electron configuration element which is not Nb, preferably from 21 to 41 at %, for example from 22 to 43 at %, such as from 23 to 42 at %, e.g. from 26 to 41 at %.

In one embodiment, there is from 27 to 48 at % of one or more sd electron configuration element which is not Nb, such as from 28 to 46 at %, for example from 28.5 to 45 at %, e.g. from 29 to 43 at %.

Preferably, Ti is present in the alloy composition in an amount of from 5 to 40 at %, preferably from 10 to 37 at %, such as from 15 to 35 at %, preferably from 20 to 32 at %, e.g. from 23 to 30 at %.

In one embodiment, at least one of Fe and Al are present in the alloy composition. For example, Fe may be present but not Al, Al may be present but not Fe, or both Fe and Al may be present. The combined amount of Fe and Al may be 0.5 at % or higher, preferably 1 at % or higher, such as from 1 to 20 at %, e.g. from 1 to 15 at %.

The present invention requires that Cr is present in an amount of from 0.5 to 9 at %, that Mo is present in an amount of from 0 to 7 at % and that Hf is present in an amount of from 0 to 7 at %. Preferably, any sd electron configuration element which is not Nb, Ti, Cr, Mo or Hf that is present in the alloy composition is present in an amount of 10 at % or less, such as 8 at % or less, preferably 7 at % or less, such as 6 at % or less, more preferably 5 at % or less.

For example, iron (Fe) may be present from 0 to 10 at %, preferably 0 to 7 at %, more preferably 0 to 5 at %.

For example, vanadium (V) may be present from 0 to 10 at %, preferably 0 to 7 at %, more preferably 0 to 5 at %.

For example, zirconium (Zr) may be present from 0 to 10 at %, preferably 0 to 7 at %, more preferably 0 to 5 at %.

For example, ruthenium (Ru) may be present from 0 to 10 at %, preferably 0 to 7 at %, more preferably 0 to 5 at %.

For example, manganese (Mn) may be present from 0 to 10 at %, preferably 0 to 7 at %, more preferably 0 to 5 at %.

For example, tantalum (Ta) may be present from 0 to 10 at %, preferably 0 to 7 at %, such as from 0 to 6 at %, e.g. from 0 to 5 at %.

In one embodiment, Hf is present in an amount of from 0 to 6 at %, such as from 0 to 5 at %. In one embodiment, Hf is not present; that is to say there is 0 at % of Hf. In another embodiment, Hf is present in an amount of from 1 to 5 at %, such as from 2 to 5 at %.

In one embodiment, Cr is present in an amount of from 0.5 to 6 at %, such as from 0.5 to 5 at %. In a preferred embodiment, Cr is present in an amount of from 1 to 5 at %, such as from 2 to 5 at %.

In the composition, the amount of Mo is 7 at % or less as high amounts of Mo will give rise to poor intermediate temperature oxidation resistance. In one embodiment, molybdenum (Mo) may be present in an amount from 0 to 6 at %, preferably 0 to 5 at %, more preferably 0 to 4 at %.

In one embodiment, the only sd electron configuration elements which are not Nb that are present are selected from Ti, Fe, Mo, Hf, Zr, Mn, Ru, V and Cr and are present in amounts as follows:

- titanium (Ti) from 5 to 40 at %, preferably from 15 to 35 at %, more preferably from 20 to 32 at %;
- iron (Fe) from 0 to 10 at %, preferably 0 to 7 at %, more preferably 0 to 5 at %;
- molybdenum (Mo) from 0 to 7 at %, preferably 0 to 6 at %, more preferably 0 to 5 at %;
- hafnium (Hf) from 0 to 7 at %, preferably 0 to 6 at %, more preferably 0 to 5 at %;
- zirconium (Zr) from 0 to 10 at %, preferably 0 to 7 at %, more preferably 0 to 5 at %;
- manganese (Mn) from 0 to 10 at %, preferably 0 to 7 at %, more preferably 0 to 5 at %;
- ruthenium (Ru) from 0 to 10 at %, preferably 0 to 7 at %, more preferably 0 to 5 at %;
- vanadium (V) from 0 to 10 at %, preferably 0 to 7 at %, more preferably 0 to 5 at %; and
- chromium (Cr) from 0.5 to 9 at %, preferably 0.5 to 7 at %, more preferably 1 to 5 at %.

In one embodiment, the ratio of the amount of Nb, in at %, to the amount of all other sd electron configuration elements, in at %, is from 0.8 to 3, such as from 0.8 to 2.8, e.g. from 0.9 to 2.6, preferably from 0.9 to 2.5, such as from 1.0 to 2.4, e.g. from 1.1 to 2.3.

The one or more sp outer electron configuration element that is not Si is optional. Accordingly, in one embodiment the only sp outer electron configuration element that is present is Si; that is to say there is 0 at % of sp outer electron configuration elements that are not Si.

However, preferably one or more sp element that is not Si is present; this gives rise to improved oxidation behaviour.

When present, the one or more sp outer electron configuration element that is not Si may be any element from Group 13, 14, 15 or 16.

In one embodiment, the one or more sp outer electron configuration element that is not Si is selected from aluminium (Al), oxygen (O), nitrogen (N), germanium (Ge), boron (B) and tin (Sn).

In one embodiment, B is present in an amount of from 0 to 10 at %, preferably from 0 to 8 at %, e.g. from 0 to 7 at %.

In one embodiment, Al may be present from 0 to 7 at %, preferably from 0 to 6 at %, more preferably 0 to 5 at %.

In one embodiment, Sn may be present from 0 to 7 at %, preferably from 0 to 6 at %, more preferably 0 to 5 at %.

In one embodiment, 0 may be present from 0 to 5 at %, preferably from 0 to 4 at %, more preferably 0 to 3 at %.

In one embodiment, N may be present from 0 to 5 at %, preferably from 0 to 4 at %, more preferably 0 to 3 at %.

In one embodiment, Ge may be present from 0 to 5 at %, such as from 0 to 4.5 at %, preferably from 0 to 4 at %, more preferably 0 to 3 at %.

In one embodiment, the one or more sp outer electron configuration element that is not Si is selected from aluminium (Al), tin (Sn), oxygen (O) and nitrogen (N); for example it may be aluminium and/or tin.

In one embodiment, the one or more sp outer electron configuration element that is not Si is selected from aluminium (Al), boron (B) and tin (Sn).

When B is present in the alloy composition, it is preferred that Al is also present.

In one embodiment, Al, B and Sn are all present as sp outer electron configuration elements that are not Si. In another embodiment, only Al and B are present. In another embodiment, only Al and Sn are present.

Preferably, Al is not the only sp outer electron configuration element used with Si. Therefore preferred combinations are Si with Al, B and Sn; Si with Sn; Si with Al and B; and Si with Al and Sn.

In one embodiment, the alloy composition contains from 0 to 25 at % of one or more sp electron configuration element which is not Si, such as from 0.5 to 20 at %. For example there may be from 0 to 15 at %, such as from 0 to 10. In one embodiment there is from 2 to 15 at %, e.g. from 3 to 10 at %.

In one embodiment, the total amount of all sp electron configuration elements, including Si, is from 10 to 35 at %, such as from 12 to 33 at %; in one embodiment from 10 to 30 at %, e.g. from 12 to 25 at %.

In one embodiment, the alloy composition contains from 2 to 22 at % of Si, such as from 3 to 20 at %, e.g. from 5 to 18 at %. In a preferred embodiment Si is present in an amount of from 2 to 18 at %, such as from 4 to 18 at %.

Preferably, the ratio of the amount in at % of all sd electron configuration metals, including Nb, to the amount in at % of all sp electron configuration elements, including Si, is from 2 to 19, e.g. from 2 to 15. Preferably, the ratio is from 2.0 to 10, such as from 2.0 to 9; in one embodiment from 2.5 to 8.5, e.g. from 3.0 to 7.5.

The total amount of B, Sn, Fe and V is 1 at % or higher in the alloy compositions of the second aspect. The presence of at least one of these elements is essential to obtaining oxidation resistance. Suitable oxidation properties may be obtained, for example, with Sn alone, or with Fe alone, or with B alone, or with Sn and V, or with Sn and B, or with Sn and V and Fe. The skilled man will appreciate that one, two, three or all four of these elements may be included in a given composition.

Preferably, the total amount of B, Sn, Fe and V is from 2 to 20 at %, such as from 3 to 20 at %, preferably from 4 to 20 at %, for example from 5 to 20 at %. In one embodiment the total amount of B, Sn, Fe and V is from 3 to 18 at %, preferably from 4 to 15 at %, e.g. from 4.5 to 15 at %, such as from 5 to 12 at %.

The total amount of Cr, Hf, Fe and B is preferably from 7 to 20 at %, such as from 7 to 18 at %, e.g. from 7 to 15 at %. The amount of these elements can be controlled in this manner in order to achieve good oxidation resistance at intermediate temperatures, e.g. of 800° C. and below.

The ratio of sd elements that are not Nb to the sp elements that are not Si is preferably from 1 to 8, more preferably from 2 to 7. The control of the ratio of these elements, to ensure that the ratio is not too high, permits good oxidation behaviour to be obtained.

As a multi phase alloy composition, there are two or more phases, such as three or more phases, e.g. two, three or four phases.

Preferably, the phases of the multi phase alloy are selected from: solid solution ($Nb_{ss}$); 5-3 silicides; 3-1 silicides; iron-niobium intermetallics ($Fe_xNb_y$); iron-niobium-silicon intermetallics ($Fe_xNb_ySi_z$), niobium-tin intermetallics ($Nb_xSn_y$), and oxides and nitrides of sd electron configuration elements (for example the phases may comprise NbN, TiN and/or $TiO_2$).

The 5-3 and 3-1 silicide phases, when present, can be tetragonal, hexagonal, cubic, equilibrium or metastable ones with or without sp and/or sd electron configuration elements in solid solution.

The iron-niobium intermetallic phase $Fe_xNb_y$ when present can be cubic, hexagonal, equilibrium or metastable. It may have sp and/or sd electron configuration elements in solid solution.

The iron-niobium-silicon intermetallic phase $Fe_xNb_ySi_z$ when present can be tetragonal, orthorhombic, equilibrium or metastable. It may have sp and/or sd electron configuration elements in solid solution.

The niobium-tin intermetallic phase $Nb_xSn_y$ when present can be cubic, orthorhombic, equilibrium or metastable. It may have sp and/or sd electron configuration elements in solid solution.

The oxides and nitride phases when present can be stoichiometric or non-stoichiometric.

The solid solution phase ($Nb_{ss}$) when present can comprise grains rich in one or more sd electron configuration metals and/or sp electron configuration elements The total volume fraction of solid solution phase $Nb_{ss}$ when there is no niobium-tin intermetallic phase $Nb_xSn_y$ present is preferably from 20 vol % to 85 vol %, such as from 25 vol % to 80 vol %, e.g. from 30 vol % to 75 vol %.

When both solid solution phase $Nb_{ss}$ and niobium-tin intermetallic phase $Nb_xSn_y$ are present, the total volume fraction of solid solution phase $Nb_{ss}$ and niobium-tin intermetallic phase $Nb_xSn_y$ is preferably from 30 vol % to 70 vol %.

In one embodiment, the alloy composition contains at least Fe as an sd electron configuration element. In such an embodiment, the ratio of the amount of Nb, in at %, to the amount of all other sd electron configuration elements, in at %, may for example be 2.5 or less, e.g. from 0.9 to 2.5. The ratio of the amount in at % of all sd electron configuration metals, including Nb, to the amount in at % of all sp electron configuration elements, including Si, may for example be 3 or more, e.g. from 3 to 5.

In one such embodiment, the alloy composition also contains Ti as an sd electron configuration element.

The ratio of the amount of Ti, in at %, to the total amount of Cr and Fe, in at %, may be from 1.5 to 18, such as from 1.8 to 15, e.g. from 1.9 to 12, for example from 2 to 11, such as from 2.4 to 12.

The alloy composition may, for example, be of formula Nb-24Ti-18Si-2Cr-1Fe (at %), or of formula Nb-24Ti-18Si-5Cr-5Fe (at %) or of formula Nb-24Ti-15Si-1Cr-1Fe-3Sn (at %), or of formula Nb-30Ti-10Si-2Al-5Cr-3Fe-5Sn-2Hf (at %) or of formula Nb-28Ti-10Al-8Si-5Cr-3Fe-3Sn-5Hf (at %) or of formula Nb-24Ti-18Si-5Cr-5Fe-5Sn (at %).

In one embodiment, the alloy composition contains at least Sn as an sp electron configuration element. In such an embodiment, the ratio of the amount of Nb, in at %, to the amount of all other sd electron configuration elements, in at %, may for example be 0.9 or more, such as from 0.9 to 2.2. The ratio of the amount in at % of all sd electron configuration metals, including Nb, to the amount in at % of all sp electron configuration elements, including Si, may for example be 15 or less, such as from 3 to 10.

In one such embodiment, the alloy composition also contains Ti as an sd electron configuration element.

In one such embodiment, the alloy composition also contains Fe as an sd electron configuration element.

The total amount of Fe and Cr, in at %, may be from 0.5 to 12, such as from 1 to 11, e.g. from 2 to 10.

The ratio of the total amount of Si and Sn, in at %, to the total amount of Cr and Fe, in at %, may be from 0.5 to 13, such as from 0.8 to 12, e.g. from 1.0 to 11, for example from 1.2 to 10, such as from 1.4 to 9.

The alloy composition may, for example, be of formula Nb-24Ti-15Si-1Cr-1Fe-3Sn (at %), or of formula Nb-30Ti-10Si-2Al-5Cr-3Fe-5Sn-2Hf (at %) or of formula Nb-28Ti-10Al-8Si-5Cr-3Fe-3Sn-5Hf (at %) or of formula Nb-24Ti-18Si-5Cr-5Fe-5Sn (at %).

In one embodiment, the alloy composition contains at least Fe as an sd electron configuration element and Al as an sp electron configuration element. In such an embodiment, the ratio of the amount of Nb, in at %, to the amount of all other sd electron configuration elements, in at %, may for example be 2 or less, e.g. from 0.9 to 1.5. The ratio of the amount in at % of all sd electron configuration metals, including Nb, to the amount in at % of all sp electron configuration elements, including Si, may for example be 6 or less, e.g. from 3 to 5.

In one such embodiment, the alloy composition also contains Ti as an sd electron configuration element.

In one such embodiment, the alloy composition also contains Hf as an sd electron configuration element.

In one such embodiment, the alloy composition also contains Sn as an sp electron configuration element.

The total amount of Ti and Hf, in at %, may be from 0 to 40, such as from 10 to 38, e.g. from 20 to 35, preferably from 25 to 35, e.g. from 30 to 33.

The ratio of the total amount of Al and Sn, in at %, to the amount of Si, in at %, may be from 0.5 to 5, such as from 0.5 to 3, e.g. from 0.6 to 2, such as from 0.7 to 1.7.

The alloy composition may, for example, be of formula Nb-28Ti-8Si-5Cr-3Sn-3Fe-10Al-5Hf (at %), or of formula Nb-30Ti-10Si-5Cr-5Sn-3Fe-2Al-2Hf (at %).

In one embodiment, the alloy composition contains at least V as an sd electron configuration element and Sn as an sp electron configuration element. In such an embodiment, the ratio of the amount of Nb, in at %, to the amount of all other sd electron configuration elements, in at %, may for example be 2 or less, e.g. from 1 to 2. The ratio of the amount in at % of all sd electron configuration metals, including Nb, to the amount in at % of all sp electron configuration elements, including Si, may for example be 8 or less, e.g. from 4 to 8.

In one such embodiment, the alloy composition also contains Ti as an sd electron configuration element.

In one such embodiment, the alloy composition also contains Hf as an sd electron configuration element.

In one such embodiment, the alloy composition also contains Al as an sp electron configuration element.

The ratio of the total amount of Ti and Hf, in at %, to the total amount of Cr and V, in at %, may be from 1.5 to 8, such as from 2 to 7, preferably from 3 to 6, e.g. from 4 to 5.

The ratio of the total amount of Ti, Al and Hf, in at %, to the total amount of Si and Sn, in at %, may be from 1.5 to 7, such as from 2 to 6, e.g. from 3 to 5.5, such as from 3.5 to 5.

The alloy composition may, for example, be of formula Nb-23Ti-6Si-6Al-5Hf-5V-1Cr-3Sn (at %), or of formula Nb-23Ti-5Si-5Al-5Hf-5V-2Cr-2Sn (at %).

Alloys in accordance with the second aspect may offer oxidation resistance at intermediate temperatures (up to 1000° C.). In particular, alloys in accordance with the second aspect may exhibit oxidation resistance at 700 to 900° C.

Specific alloys in accordance with the second aspect are:

Nb-23Ti-6Si-6Al-5Hf-5V-1Cr-3Sn
Nb-23Ti-5Si-5Al-5Hf-5V-2Cr-2Sn
Nb-28Ti-8Si-5Cr-3Sn-3Fe-10Al-5Hf
Nb-30Ti-10Si-5Cr-5Sn-3Fe-2Al-2Hf
Nb-24Ti-15Si-1Cr-1Fe-3Sn
Nb-30Ti-10Si-2Al-5Cr-3Fe-5Sn-2Hf
Nb-28Ti-10Al-8Si-5Cr-3Fe-3Sn-5Hf
Nb-24Ti-18Si-5Cr-5Fe-5Sn
Nb-24Ti-18Si-2Cr-1Fe
Nb-24Ti-18Si-5Cr-5Fe
Nb-24Ti-18Si-5B-5Cr
Nb-24Ti-18Si-5B-5Cr-5Al
Nb-24Ti-18Si-5B-5Cr-5Al-6Ta
Nb-24Ti-18Si-5B-5Cr-5Al-5Sn
Nb-24Ti-18Si-5B-5Cr-5Al-5Hf
Nb-24Ti-18Si-5B-5Cr-5Al-2Mo
Nb-24.5Ti-15.7Si-6.9B-5.4Cr-5Al
Nb-23.7Ti-16.4Si-6.3B-4.9Cr-4.6Al-5.5Ta
Nb-23.7Ti-17.5Si-6.7B-5.2Cr-3.4Al-4.2Sn
Nb-23.3Ti-17Si-5.2B-4.7Cr-4.3Al-4.7Hf
Nb-23Ti-17.2Si-6.3B-4.8Cr-3.5Al-2Mo
Nb-24.1Ti-16.8Si-7B-5.3Cr-4.1Sn-3.2Al

The invention also provides, in a third aspect, an article comprising the alloy of the first aspect or the second aspect.

In one embodiment the article is a turbine or turbine component, for example in relation to aeronautical turbines, jet engine turbines, marine turbines and land based turbines. In one particular embodiment, the article may be a gas turbine engine blade. Other components of a turbine include a vane, bucket or stator.

In one embodiment, the article is a gas turbine engine blade and the tip of the gas turbine engine blade comprises an alloy in accordance with the first aspect. For example, the tip of the gas turbine engine blade may be made from an alloy in accordance with the first aspect. It may, optionally, be coated with a coating such as a thermal barrier coating.

In one embodiment, the article is a gas turbine engine blade and the root of a gas turbine engine blade comprises an alloy in accordance with the second aspect. For example, the root of a gas turbine engine blade may be made from an alloy in accordance with the second aspect. It may, optionally, be coated with a coating such as a thermal barrier coating.

The article may also be a component of a rocket, re-entry vehicle or hypersonic flight vehicle. For example, it may be a rocket component which is a rocket propulsion unit or a nozzle, a hypersonic flight vehicle component which is a leading edge or a nose cap, or a re-entry vehicle component which is a guidance structure.

The invention also provides, in a fourth aspect, the use of an alloy according to the first aspect or the second aspect to increase the creep resistance of an article, e.g. a turbine component or a component of a rocket, re-entry vehicle or hypersonic flight vehicle. The article may be one of the types of article as referred to in the third aspect. In one embodiment, the article is a gas turbine engine blade.

In one such embodiment, the use is in relation to the tip of a gas turbine engine blade and the alloy is in accordance with the first aspect.

The alloy of the first aspect may be used to increase the creep resistance at 1050° C. or higher, e.g. 1100° C. or higher, such as 1200° C. or higher.

In one such embodiment, the use is in relation to the root of a gas turbine engine blade and the alloy is in accordance with the second aspect.

The alloy of the second aspect may be used to increase the creep resistance at 700° C. or higher, e.g. 700 to 900° C. or higher; it may be 1050° C. or higher, such as 1200° C. or higher.

The invention also provides, in a fifth aspect, the use of an alloy according to the second aspect to increase the oxidation resistance of an article, e.g. a turbine component or a component of a rocket, re-entry vehicle or hypersonic flight vehicle. The article may be one of the types of article as referred to in the third aspect. In one embodiment, the article is a gas turbine engine blade.

In one such embodiment, the use is in relation to the root of a gas turbine engine blade.

The alloy of the second aspect may be used to increase the oxidation resistance at 700° C. or higher, e.g. at 700 to 800° C., or at 700 to 900° C.; it may be 1050° C. or higher, such as 1200° C. or higher.

EXAMPLES

Method of Production

All alloys were prepared by arc-melting commercial purity elements (99.9 wt % or better purity) with a non-consumable electrode in a water-cooled crucible under argon atmosphere.

Ingots of polycrystalline alloys, each of about 300 g, were prepared.

For heat treatment, specimens were wrapped in Ta foil, placed in an alumina boat and heat-treated at the selected temperature (in the range 1000° C. to 1500° C.) in a tube furnace under argon flow. An alumina boat with Ti sponge was placed at the entrance of the argon flow in the tube furnace.

Method of Testing (a) Compressive Creep Test

Unless otherwise stated, the creep results given were measured from compressive creep tests.

For these tests cylindrical samples of 4 mm in diameter and 6 mm in height were cut from the cast and the heat treated material using spark erosion and polished on both compression sides to enable truly uni-axial loading of the samples and to reduce friction.

The creep tests were conducted at 1050 and/or 1200° C. in an electromechanical testing device equipped with a high temperature furnace, which enables testing under argon atmosphere or vacuum. An extensometer provided continuous monitoring of creep strain by measuring the displacement of the compression punches inside the furnace.

This setup offers testing under constant true strain rate as well as constant stress conditions through closed loop control via a personal computer.

(b) Flexural Creep Test

Where specified, creep results were assessed using flexural creep testing.

Flexural creep tests are used to provide a quick guide to high-temperature mechanical properties. Simple models are used to characterise stress and strain:

'Outer fibre' flexural stress is computed as the elastic stress in a bent beam

'Outer fibre' flexural strain is computed from the curvature of the test-piece and similarly assumes elastic behaviour.

The flexural creep testing was carried out using:

1. Severn Science flexural creep rig at NPL
2. Four-point flexure jig in alumina
3. 40 mm outer span
4. 20 mm inner span
5. Force applied by 5:1 lever loading outside furnace
6. Displacement measured between centre and one loading roller by a pair of differential transducers
7. Split SiC element furnace, maximum temperature capability 1500° C.

(c) Pest Oxidation

Pest oxidation is oxidation that leads to disintegration of the oxidised material to powder form. There is always a significant volume increase upon oxidation. Pest oxidation occurs at temperatures below 1000° C., typically in the range 700 to 800° C., and is known to be a problem of Nb and Nb alloys. Thus, any Nb alloy for applications below 1000° C. is required to have resistance to pest oxidation.

Testing was carried out at 700, 800 and 900° C. Visual examination of oxidised material was used to confirm that pest oxidation has occurred. Specifically, the tests start with a cubic specimen; if pest oxidation has occurred the result is a powder.

Note in Relation to Creep Behaviour

The skilled man would understand that for a particular alloy composition, the creep behaviour is dependent upon the form of the alloy. In this regard, when evaluating creep behaviour using the same method, for the same stress level and temperature, the creep behaviour of a polycrystalline form of the alloy composition would be worse than the creep behaviour for a directionally solidified form of the alloy, which in turn would have worse creep behaviour that a single crystal form of the alloy composition.

Therefore the present examples, for alloy compositions in polycrystalline form, would in fact show better creep results if the same alloy in directionally solidified form or in single crystal form were tested.

Comparative Example A: 47Nb-25Ti-16Si-8Hf-2Cr-2Al

Polycrystalline (Non Directional Solidification) Nb Silicide Based Alloy Known as MASC (a) Heat treated—testing at 1050° C.
(i) Stress 100 MPa Creep rate: 6.0 $10^{-7}$ $s^{-1}$
(ii) Stress 143 MPa Creep rate: 2.2 $10^{-6}$ $s^{-1}$
(iii) Stress 185 MPa Creep rate: 7.8 $10^{-6}$ $s^{-1}$
(b) Heat treated—testing at 1200° C.
(i) Stress 100 MPa Creep rate: 2.7 $10^{-5}$ $s^{-1}$
(ii) Stress 125 MPa Creep rate: 7.4 $10^{-5}$ $s^{-1}$

Comparative Example B: Single Crystal Ni Based Superalloy CSMX-4

Typical Composition Ni-9Co-6.5Cr-6W-5.6Al-6.5Ta-3Re-1Ti-0.6Mo-0.1Hf (wt %)

(a) Heat treated—testing at 1050° C.
(i) Stress 150 MPa Creep rate: 2.8 $10^{-8}$ $s^{-1}$
(ii) Stress 200 MPa Creep rate: 1.3 $10^{-7}$ $s^{-1}$
(b) Heat treated—testing at 1200° C.
(i) Stress 50 MPa Creep rate: 4 $10^{-7}$ $s^{-1}$
(ii) Stress 100 MPa Creep rate: 2 $10^{-6}$ $s^{-1}$
(iii) Stress 150 MPa Creep rate: 6.3 $10^{-5}$ $s^{-1}$ Examples 1 to 13—Alloys for Use in Tip of Blade Key Criterion: Creep Resistance Above 1000° C.

Example 1 Nb-18Si-5Cr-5Hf (a) As cast—testing at 1050° C.
(i) Stress 200 MPa Creep rate: 2.6 $10^{-9}$ $s^{-1}$
(ii) Stress 299 MPa Creep rate: 1.6 $10^{-8}$ $s^{-1}$
(iii) Stress 397 MPa Creep rate: 5.4 $10^{-8}$ $s^{-1}$ Example 2: Nb-18Si-5Hf-5Al (a) As cast—testing at 1050° C.
(i) Stress 200 MPa Creep rate: 7.5 $10^{-9}$ $s^{-1}$
(ii) Stress 300 MPa Creep rate: 3.8 $10^{-8}$ $s^{-1}$
(iii) Stress 398 MPa Creep rate: 7.1 $10^{-8}$ $s^{-1}$ Comparative Example 3: Nb-22Ti-18.5Si-5Hf (a) As cast—testing at 1050° C.
(i) Stress 197 MPa Creep rate: 8.6 $10^{-8}$ $s^{-1}$
(b) As cast—testing at 1200° C.
(i) Stress 100 MPa Creep rate: 3.5 $10^{-7}$ $s^{-1}$
(c) Heat treated—testing at 1050° C.
(i) Stress 144 MPa Creep rate: 5.7 $10^{-8}$ $s^{-1}$
(ii) Stress 132 MPa Creep rate: 3.4 $10^{-7}$ $s^{-1}$
(iii) Stress 190 MPa Creep rate: 1.5 $10^{-7}$ $s^{-1}$ Example 4: Nb-18Si-5Hf-3Ta-2Mo (a) As cast—testing at 1050° C.
(i) Stress 299 MPa Creep rate: 7.0 $10^{-9}$ $s^{-1}$
(b) As cast—testing at 1200° C.
(i) Stress 197 MPa Creep rate: 4.4 $10^{-8}$ $s^{-1}$
(ii) Stress 200 MPa Creep rate: 5.2 $10^{-8}$ $s^{-1}$
(iii) Stress 297 MPa Creep rate: 1.9 $10^{-7}$ $s^{-1}$
(iv) Stress 392 MPa Creep rate: 7.6 $10^{-7}$ $s^{-1}$
(c) Heat treated—testing at 1200° C.
(i) Stress 199 MPa Creep rate: 8.5 $10^{-8}$ $s^{-1}$
(ii) Stress 294 MPa Creep rate: 3.5 $10^{-7}$ $s^{-1}$ Example 5: Nb-22Si-5Hf-5W (a) As cast—testing at 1200° C.
(i) Stress 199 MPa Creep rate: 9.5 $10^{-9}$ $s^{-1}$
(ii) Stress 297 MPa Creep rate: 6.8 $10^{-8}$ $s^{-1}$
(iii) Stress 393 MPa Creep rate: 2.2 $10^{-7}$ $s^{-1}$
(b) Heat treated—testing at 1200° C.
(i) Stress 199 MPa Creep rate: 1.1 $10^{-8}$ $s^{-1}$
(ii) Stress 297 MPa Creep rate: 7.2 $10^{-8}$ $s^{-1}$
(iii) Stress 394 MPa Creep rate: 1.9 $10^{-7}$ $s^{-1}$ Example 6: Nb-22Si-5Mo-3W (a) As cast—testing at 1200° C.
(i) Stress 198 MPa Creep rate: 1.4 $10^{-7}$ $s^{-1}$
(ii) Stress 291 MPa Creep rate: 4.3 $10^{-7}$ $s^{-1}$
(b) Heat treated—testing at 1050° C.
(i) Stress 299 MPa Creep rate: 5 $10^{-9}$ $s^{-1}$
(ii) Stress 397 MPa Creep rate: 1 $10^{-8}$ $s^{-1}$ Example 7: Nb-18Si-10Ti-5Mo-3W-1Hf (a) As cast—testing at 1200° C.
(i) Stress 197 MPa Creep rate: 1.1 $10^{-7}$ $s^{-1}$
(ii) Stress 291 MPa Creep rate: 4.1 $10^{-7}$ $s^{-1}$
(b) As cast—testing at 1050° C.
(i) Stress 199 MPa Creep rate: 6.0 $10^{-9}$ $s^{-1}$
(ii) Stress 298 MPa Creep rate: 1.5 $10^{-8}$ $s^{-1}$
(iii) Stress 396 MPa Creep rate: 2.6 $10^{-8}$ $s^{-1}$ Example 8: Nb-20Si-5Hf-5Mo-3W (a) As cast—testing at 1050° C.
(i) Stress 200 MPa Creep rate: 9.0 $10^{-9}$ $s^{-1}$
(ii) Stress 300 MPa Creep rate: 8.5 $10^{-9}$ $s^{-1}$
(b) As cast—testing at 1200° C.
(i) Stress 125 MPa Creep rate: 3.6 $10^{-8}$ $s^{-1}$
(ii) Stress 150 MPa Creep rate: 5.5 $10^{-8}$ $s^{-1}$
(iii) Stress 200 MPa Creep rate: 8.4 $10^{-8}$ $s^{-1}$
(iv) Stress 300 MPa Creep rate: 3.4 $10^{-7}$ $s^{-1}$ Example 9: Nb-19Si-11Ti-5Mo-3W (a) As cast—testing at 1050° C.
(i) Stress 300 MPa Creep rate: 5.0 $10^{-8}$ $s^{-1}$
(ii) Stress 400 MPa Creep rate: 8.3 $10^{-8}$ $s^{-1}$
(b) As cast—testing at 1200° C.
(i) Stress 146 MPa Creep rate: 1.5 $10^{-7}$ $s^{-1}$
(ii) Stress 193 MPa Creep rate: 3.46 $10^{-7}$ $s^{-1}$
(iii) Stress 200 MPa Creep rate: 4.9 $10^{-7}$ $s^{-1}$
(iv) Stress 285 MPa Creep rate: 1.6 $10^{-6}$ $s^{-1}$ Example 10: Nb-11Ti-20Si-5Hf-5Mo-3W (a) As cast—testing at 1050° C.
(i) Stress 400 MPa Creep rate: 1.2 $10^{-8}$ $s^{-1}$
(b) As cast—testing at 1200° C.
(i) Stress 145 MPa Creep rate: 2.65 $10^{-7}$ $s^{-1}$
(ii) Stress 187 MPa Creep rate: 6.93 $10^{-7}$ $s^{-1}$ Example 11: Nb-20Si-11Ti-5Al-5Hf-5Mo-3W (a) As cast—testing at 1050° C.
(i) Stress 200 MPa Creep rate: 2 $10^{-8}$ $s^{-1}$
(ii) Stress 300 MPa Creep rate: 1 $10^{-7}$ $s^{-1}$
(iii) Stress 400 MPa Creep rate: 3 $10^{-7}$ $s^{-1}$ Example 12: Nb-22Si-5V-5Zr-3W (a) As cast—testing at 1200° C.
(i) Stress 199 MPa Creep rate: 7.1 $10^{-8}$ $s^{-1}$
(ii) Stress 295 MPa Creep rate: 3.1 $10^{-7}$ $s^{-1}$ Example 13: Nb-22Si-10Ti-5Al-3W-2Cr-2V-1Hf (a) As cast—testing at 1050° C.
(i) Stress 296 MPa Creep rate: 2.1 $10^{-7}$ $s^{-1}$
(ii) Stress 384 MPa Creep rate: 9.2 $10^{-7}$ $s^{-1}$ Example 13 was also tested using flexural creep testing.

At a stress of 100 MPa, the alloy of example 13 did not creep up to 1000° C. Nominal flexural strain equal to or less than 0.002 was measured 1200° C.

Examples 14 to 21—Alloys for Use in Root of Blade

Key Criterion: Resistance to Oxidation at 700-900° C.

| Compositions (at %) of alloys | | | | | | | | | |
|---|---|---|---|---|---|---|---|---|---|
| Example | Nb | Si | Ti | Cr | Al | V | Fe | Hf | Sn |
| Comparative E.g. 14 | Bal | 18 | 0 | 0 | 0 | 0 | 0 | 0 | 5 |
| Comparative E.g. 15 | Bal | 18 | 24 | 0 | 0 | 0 | 0 | 0 | 5 |
| Comparative E.g. 16 | Bal | 18 | 24 | 0 | 0 | 0 | 5 | 0 | 5 |
| Comparative E.g. 17 | Bal | 15 | 45 | 0 | 0 | 0 | 5 | 0 | 5 |
| E.g. 18 | Bal | 18 | 24 | 5 | 0 | 0 | 5 | 0 | 0 |
| E.g. 19 | Bal | 18 | 24 | 5 | 0 | 0 | 5 | 0 | 5 |
| E.g. 20 | Bal | 5 | 23 | 2 | 5 | 5 | 0 | 5 | 2 |
| E.g. 21 | Bal | 10 | 30 | 5 | 2 | 0 | 3 | 2 | 5 |

Bal = balance out of 100 at %

Oxidation

Comparative E.g. 14

At 700° C. alloy suffers disintegration from pest oxidation after 15 h

At 800° C. alloy suffers total disintegration from pest oxidation after 12 h

At 900° C. alloy suffers total disintegration from pest oxidation after 7 h

Comparative E.g. 15

At 700° C. oxidation behaviour the same as for alloy 16

At 800° C. oxidation behaviour slightly better than that of alloy 16, but still evidence of severe oxidation at edges At 900° C. complete disintegration to powders due to pest oxidation occurring after 15 h Comparative E.g. 16

At 700° C. oxidation behaviour the same as for alloy 17

At 800° C. oxidation behaviour slightly better than that of alloy 17, but evidence of severe oxidation at edges At 900° C. total disintegration to powder due to pest oxidation occurring after 25 h Comparative E.g. 17

At 700° C. oxidation behaviour the same as alloy 21, no pest oxidation

At 800° C. poor oxidation behaviour, could pest after prolonged exposure

At 900° C. even worse oxidation compared to that at 800 C, pest oxidation after 100 h Examples 18 to 21

No visual signs of oxidation at 700-900° C.

Creep

The creep for Example 21 was evaluated using flexural creep testing. The alloy of this example did not creep up to 800° C. at a stress of 100 MPa. Nominal flexural strain equal to or less than 0.002 was measured at 1000° C. for this alloy.

Examples 22-27

The following alloys were also provided:

| | Element (at. %) | | | | | | |
|---|---|---|---|---|---|---|---|
| Example | Nb | Ti | Si | B | Cr | Al | Other |
| 22 | 48 | 24 | 18 | 5 | 5 | 0 | 0 |
| 23 | 43 | 24 | 18 | 5 | 5 | 5 | 0 |
| 24 | 37 | 24 | 18 | 5 | 5 | 5 | 6(Ta) |
| 25 | 38 | 24 | 18 | 5 | 5 | 5 | 5(Sn) |
| 26 | 38 | 24 | 18 | 5 | 5 | 5 | 5(Hf) |
| 27 | 41 | 24 | 18 | 5 | 5 | 5 | 2(Mo) |

These provide good oxidation resistance in the range 700-900° C., e.g. at 800° C.

Examples 23 to 27 also provide good oxidation resistance above 1000° C., e.g. at 1200° C.

Examples 28-33

The following alloys were also provided and tested against the known GE alloy MASC (47.2Nb-24.7Ti-16Si-8.2Hf-2Cr-1.9Al):

28: Nb-24.5Ti-15.7Si-6.9B-5.4Cr-5Al
29: Nb-23.7Ti-16.4Si-6.3B-4.9Cr-4.6Al-5.5Ta
30: Nb-23.7Ti-17.5Si-6.7B-5.2Cr-3.4Al-4.2Sn
31: Nb-23.3Ti-17Si-5.2B-4.7Cr-4.3Al-4.7Hf
32: Nb-23Ti-17.2Si-6.3B-4.8Cr-3.5Al-2Mo
33: Nb-24.1Ti-16.8Si-7B-5.3Cr-4.1Sn-3.2Al

Oxidation Resistance at 800° C.:

Alloys 28 to 33 performed better than MASC for oxidation resistance.

Oxidation Resistance at 1200° C.:

Alloys 28 to 33 performed better than MASC for oxidation resistance.

The invention claimed is:

1. A multi-phase niobium silicide alloy composition, consisting of:

(i) from 5 to 18 at % of Si,
(ii) from 23 to 30 at % of Ti,
(iii) from 0 to less than 5 at % of Al,
(iv) from 0 to 5 at % of Hf,
(v) from 0 to 5 at % of V,
(vi) from 1 to 5 at % of Cr,
(vii) from 0 to 5 at % of Sn,
(viii) from 0 to 5 at % of Fe,
(ix) from 0 to 7 at % of B,
(x) from 0 to 6 at % of Ta,
(xi) from 0 to 2 at % of Mo,
(xii) from 0 to 10 at % of Mn,
(xiii) from 0 to 10 at % of Zr,
(xiv) up to 0.5 at % impurities, and
(xv) balance Nb, wherein the ratio of the amount of Nb, in at %, to the amount of all other sd electron configuration elements, in at %, is from 1.0 to 2.4, the all other sd electron configuration elements are Ti, Cr, Hf, Ta, Zr, Mo, V, Mn and Fe, and at least one of the elements B, Fe and V is present and each of these elements that is present is independently included in an amount above 1 at %.

2. The alloy of claim 1 wherein the total amount of B, Sn, Fe and V is from 3 to 20 at %.

3. The alloy of claim 2 wherein the total amount of B, Sn, Fe and V is from 4.5 to 15 at %.

4. The alloy of claim 1 wherein the total amount of Cr, Hf, Fe and B is from 7 to 20 at %.

5. The alloy of claim 1 wherein the ratio of sd elements that are not Nb to the sp elements that are not Si is from 1 to 8.

6. The alloy of claim 1 wherein the ratio of sd elements that are not Nb to the sp elements that are not Si is from 2 to 7.

7. The alloy of claim 1 wherein the total amount of Al, B, Sn and Si, is from 10 to 30 at %.

8. An article comprising the alloy of claim 1 wherein the article is a turbine component, a rocket component, a re-entry vehicle component or a hypersonic flight vehicle component.

9. The alloy of claim 1 wherein B is present in the alloy.

10. The alloy of claim 1 wherein the ratio of the amount of Nb, in at %, to the amount of all other ad electron configuration elements, in at %, is from 1.1 to 2.4.

11. The alloy of claim 1 wherein the ratio of the amount of Nb, in at %, to the amount of all other sd electron configuration elements, in at %, is from 1.1 to 2.3.

12. The alloy of claim 1 wherein Al is present in an amount of 0 at %.

13. A gas turbine engine blade comprising the multi-phase niobium silicide alloy composition of claim 1.

14. The multi-phase niobium silicide alloy composition of claim 1 wherein Zr is present in an amount of 0 to 7 at %.

15. The multi-phase niobium silicide alloy composition of claim 1 wherein Zr is present in an amount of 0 to 5 at %.

16. The multi-phase niobium silicide alloy composition of claim 1 wherein Mn is present in an amount of 0 to 7 at %.

17. The multi-phase niobium silicide alloy composition of claim 1 wherein Mn is present in an amount of 0 to 5 at %.

18. The multi-phase niobium silicide alloy composition of claim 1 wherein Zr is present in an amount of 0 to 5 at %, and Mn is present in an amount of 0 to 5 at %.

19. The multi-phase niobium silicide alloy composition of claim 1 wherein:

the total amount of B, Sn, Fe and V is from 4.5 to 15 at %, and the ratio of sd elements that are not Nb to the sp elements that are not Si is from 2 to 7.

20. The multi-phase niobium silicide alloy composition of claim 18 wherein:

the total amount of B, Sn, Fe and V is from 4.5 to 15 at %, and the ratio of sd elements that are not Nb to the sp elements that are not Si is from 2 to 7.

21. The alloy of claim 19 wherein B is present in the alloy.

22. The alloy of claim 20 wherein B is present in the alloy.

23. The alloy of claim 19 wherein Al is present in an amount of 0 at %.

24. The alloy of claim 20 wherein Al is present in an amount of 0 at %.

25. The alloy of claim 1, wherein the alloy has a creep rate of less than $6.3\times10^{-5}$ $s^{-1}$ at 150 MPa.

26. A gas turbine engine blade comprising a blade root and a blade tip, wherein the blade root consists of the multi-phase niobium silicide alloy composition of claim 1, and the blade tip consists of a second multi phase niobium silicide alloy composition consisting essentially of:

a) from 15 to 24 at % of Si;

b) from 0 to 25 at % of one or more sp outer electron configuration element which is not Si;

c) from 1 to 26 at % of one or more sd outer electron configuration element which is not Nb; and d) a balance of Nb, interstitials and impurities;

wherein, for the second multi-phase niobium silicide alloy composition:

(i) the ratio of the amount of Nb, in at %, to the amount of all other sd electron configuration elements, in at %, is from 1.2 to 40;

(ii) the total amount of all sp electron configuration elements, including Si, is from 18 to 40 at %;

(iii) Ti is present in an amount of from 0 to 23 at %;

(iv) Hf is present in an amount of from 0 to 7 at %;

(v) C is present in an amount of from 0 to 2 at %;

(vi) the total amount of Nb and Si is from 49 to 93 at %;

(vii) any sd electron configuration element which is not Nb, Ti or Hf is present in an amount of 8 at % or less.

27. The gas turbine engine blade of claim 26, wherein, for the second multi-phase niobium silicide alloy composition, the one or more sd electron configuration element which is not Nb includes one or more refractory metals.

28. The gas turbine engine blade of claim 27, wherein, for the second multi-phase niobium silicide alloy composition, the refractory metal is selected from tungsten, tantalum, molybdenum, hafnium, zirconium, vanadium, and chromium.

29. The gas turbine engine blade of claim 28, wherein, for the second multi-phase niobium silicide alloy composition, the composition includes one or both of W and Hf.

30. The gas turbine engine blade of claim 29, wherein, for the second multi-phase niobium silicide alloy composition, the total amount of W and Hf present in the composition is from 1 to 15 at %.

31. The gas turbine engine blade of claim 27, wherein, for the second multi-phase niobium silicide alloy composition, the one or more sd electron configuration element which is not Nb includes one or more refractory metal together with one or more non refractory metal.

32. The gas turbine engine blade of claim 31, wherein, for the second multi-phase niobium silicide alloy composition, the non refractory metal is titanium.

33. The gas turbine engine blade of claim 26, wherein, for the second multi-phase niobium silicide alloy composition, there is from 5 to 24 at % of one or more sd outer electron configuration element which is not Nb.

34. The gas turbine engine blade of claim 26, wherein, for the second multi-phase niobium silicide alloy composition, the alloy includes two or more elements in addition to Nb and Si.

35. The gas turbine engine blade of claim 26, wherein, for the second multi-phase niobium silicide alloy composition, any sd electron configuration element which is not Nb, Ti or Hf that is present in the alloy composition is present in an amount of 5 at % or less.

36. The gas turbine engine blade of claim 26, wherein, for the second multi-phase niobium silicide alloy composition, Ti is present in an amount of from 0 to 15 at %.

37. The gas turbine engine blade of claim 26, wherein, for the second multi-phase niobium silicide alloy composition, Hf is present in an amount of from 0 to 5 at %.

38. The gas turbine engine blade of claim 26, wherein, for the second multi-phase niobium silicide alloy composition, the ratio of the amount of Nb, in at %, to the amount of all other sd electron configuration elements, in at %, is from 1.8 to 20.

39. The gas turbine engine blade of claim 26, wherein, for the second multi-phase niobium silicide alloy composition, when present, the one or more sp outer electron configuration element that is not Si is selected from aluminum, oxygen, nitrogen, germanium, boron and tin.

40. The gas turbine engine blade of claim 26, wherein, for the second multi-phase niobium silicide alloy composition, the alloy composition contains from 0 to 10 at % of one or more sp electron configuration element which is not Si.

41. The gas turbine engine blade of claim 26, wherein, for the second multi-phase niobium silicide alloy composition, the total amount of all sp electron configuration elements, including Si, is from 16 to 30 at %.

42. The gas turbine engine blade of claim 26, wherein, for the second multi-phase niobium silicide alloy composition, the ratio of the amount in at % of all sd electron configuration metals, including Nb, to the amount in at % of all sp electron configuration elements, including Si, is from 1.9 to 6.0.

43. The gas turbine engine blade of claim 42, wherein, for the second multi-phase niobium silicide alloy composition, the ratio of the amount in at % of all sd electron configuration metals, including Nb, to the amount in at % of all sp electron configuration elements, including Si, is from 2.0 to 5.5.

* * * * *